US007144219B2

(12) United States Patent
Hancock

(10) Patent No.: US 7,144,219 B2
(45) Date of Patent: Dec. 5, 2006

(54) CUTOFF FOR FAN OR BLOWER

(75) Inventor: Stephen S. Hancock, Flint, TX (US)

(73) Assignee: American Standard International Inc., New York, NY (US)

( * ) Notice: Subject to any disclaimer, the term of this patent is extended or adjusted under 35 U.S.C. 154(b) by 85 days.

(21) Appl. No.: 10/835,376

(22) Filed: Apr. 29, 2004

(65) Prior Publication Data

US 2004/0253099 A1 Dec. 16, 2004

Related U.S. Application Data

(63) Continuation-in-part of application No. 10/461,042, filed on Jun. 13, 2003.

(51) Int. Cl.
*F04D 29/44* (2006.01)

(52) U.S. Cl. ..... 415/212.1; 415/206; 415/119; 415/53.3

(58) Field of Classification Search ..... 415/53.1, 415/53.2, 53.3, 119, 203, 204, 206, 211.1, 415/212.1

See application file for complete search history.

(56) References Cited

U.S. PATENT DOCUMENTS 5,279,515 A 1/1994 Moore et al.
5,449,271 A * 9/1995 Bushnell et al. ..... 415/119
5,570,996 A 11/1996 Smiley, III
5,772,399 A 6/1998 Mehta et al.
5,868,551 A 2/1999 Smiley, III et al.
6,200,093 B1 * 3/2001 Lee et al. ..... 415/204
6,677,564 B1 1/2004 Sohn et al.

OTHER PUBLICATIONS

Publication: "The Leader", Title: "New Air Handler Features Better Performance in a Smaller Cabinet", Spring 2004, p. 6, vol. 13, Issue 1.

* cited by examiner

*Primary Examiner*—Edward K. Look
*Assistant Examiner*—Dwayne J White
(74) *Attorney, Agent, or Firm*—William J. Beres; William O'Driscoll

(57) ABSTRACT

A cutoff for a blower housing. The cutoff comprises a cutoff having an edge, the edge includes first and second ends and a midsection. The midsection includes an acoustical reduction section. Each end includes an efficiency enhancing portion curving from a first smaller radial dimension to a second greater radial dimension proximal the acoustical reduction section. The acoustical reduction section is located between the first and second ends and has a greater third radial dimension greater than the first or second radial dimensions.

75 Claims, 7 Drawing Sheets

FIG. 2
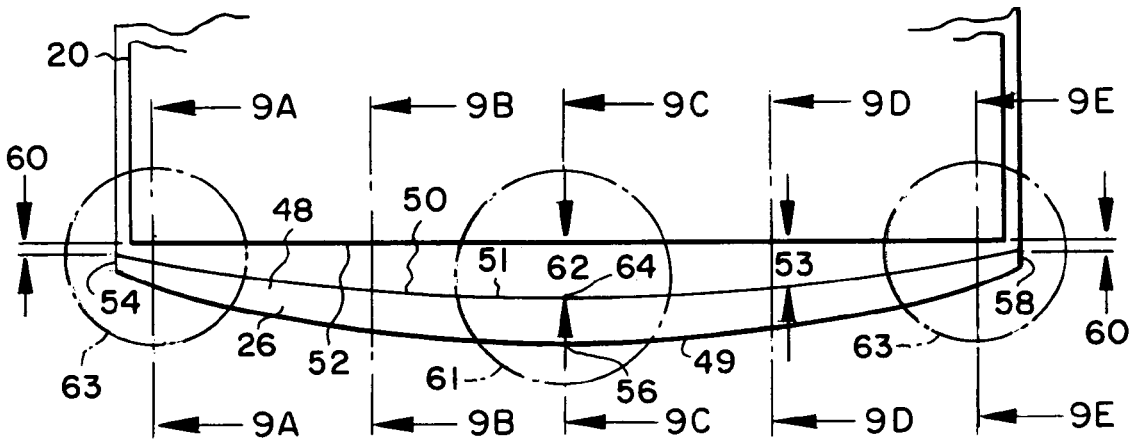
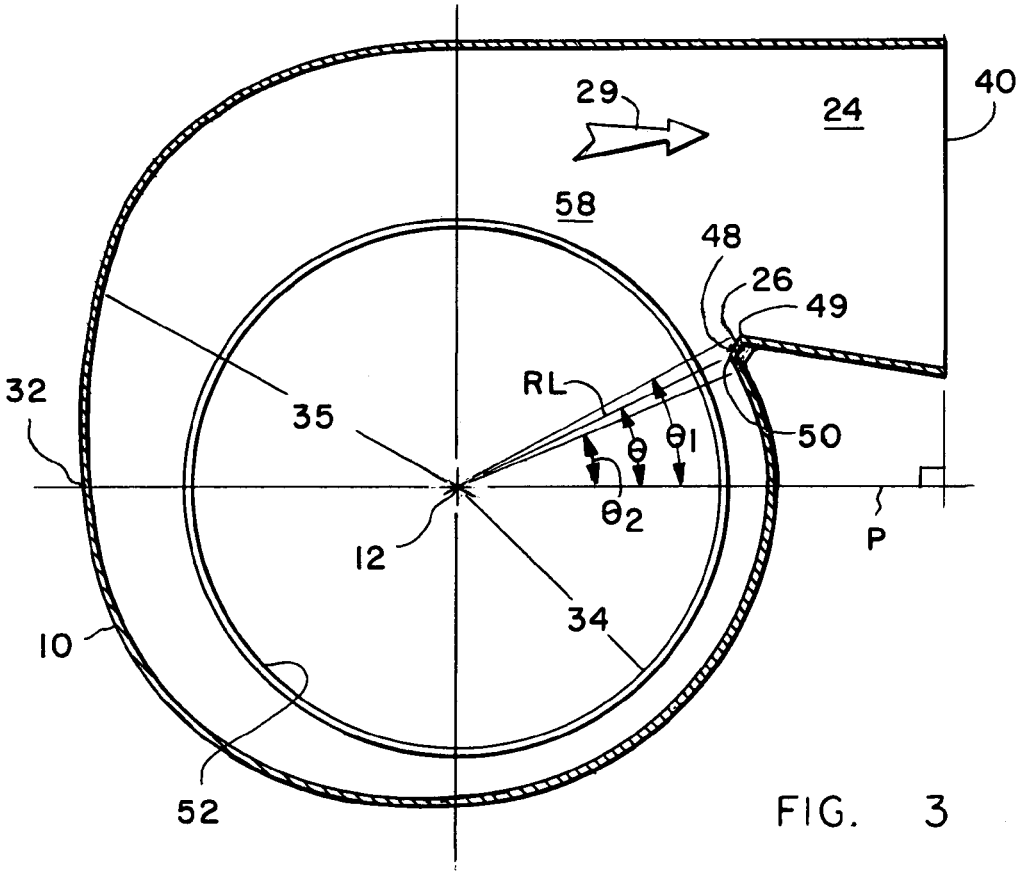
FIG. 3

FIG. 5

| | DISTANCE FROM BLADES | | | FACE WIDTH | | |
|---|---|---|---|---|---|---|
| | ENDPOINT 1 | ENDPOINT 2 | MIDPOINT | ENDPOINT 1 | ENDPOINT 2 | MIDPOINT |
| FIG. 4a | 142<br>142 = 144<br>142 < 146 | 144<br>142 = 144<br>144 < 146 | 146<br>146 > 142<br>146 > 144 | 152<br>152 = 148<br>152 = 150 | 148<br>148 = 152<br>148 = 150 | 150<br>150 = 148<br>150 = 152 |
| FIG. 4b | 154<br>154 = 158<br>154 < 156 | 158<br>158 = 154<br>158 < 156 | 156<br>156 > 158<br>156 > 154 | 160<br>160 = 164<br>160 < 162 | 164<br>164 = 160<br>164 < 162 | 162<br>162 > 160<br>162 > 164 |
| FIG. 4c | 166<br>166 < 168<br>166 < 170 | 170<br>170 > 166<br>170 < 168 | 168<br>168 > 166<br>168 > 170 | 172<br>172 = 176<br>172 < 174 | 176<br>176 = 172<br>176 < 174 | 174<br>174 > 176<br>174 > 174 |
| FIG. 4d | 178<br>178 = 182<br>178 < 180 | 182<br>178 = 182<br>182 < 180 | 180<br>180 > 178<br>180 > 182 | 184<br>184 < 188<br>184 < 186 | 186<br>186 > 184<br>186 > 188 | 188<br>188 > 184<br>188 > 200 |
| FIG. 4e | 190<br>190 > 194<br>190 < 192 | 194<br>194 < 190<br>194 < 192 | 192<br>192 > 190<br>192 > 194 | 196<br>196 > 200<br>196 < 192 | 200<br>200 < 196<br>200 < 198 | 198<br>198 > 196<br>198 > 200 |

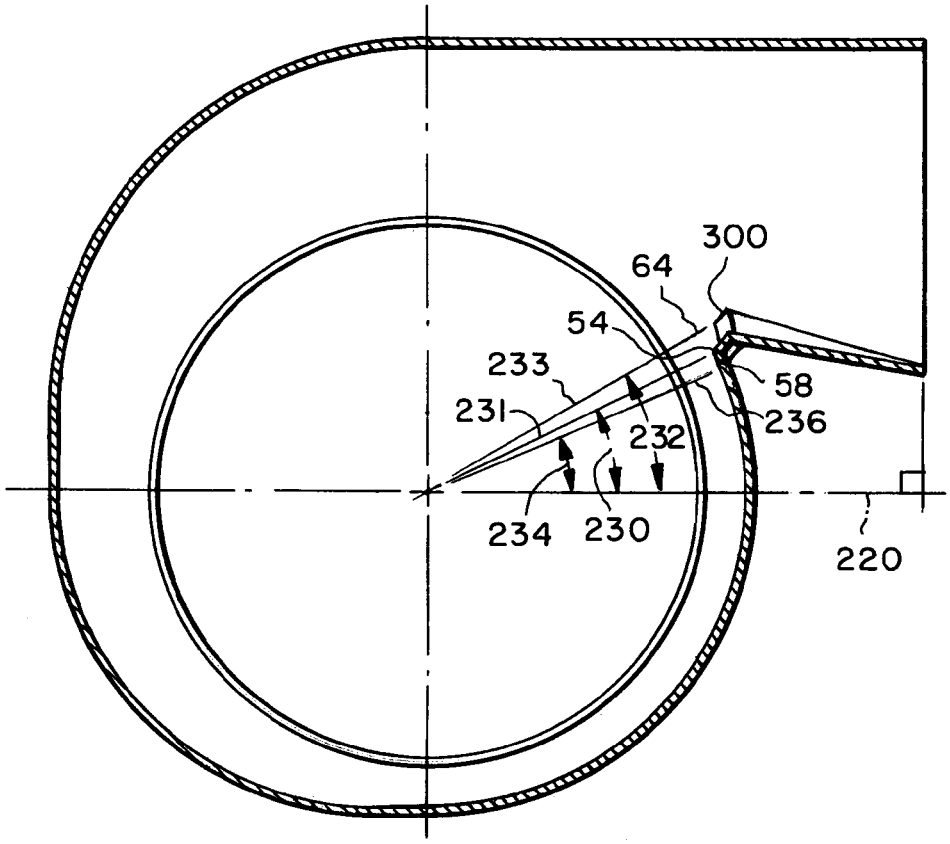
FIG. 7
FIG. 8
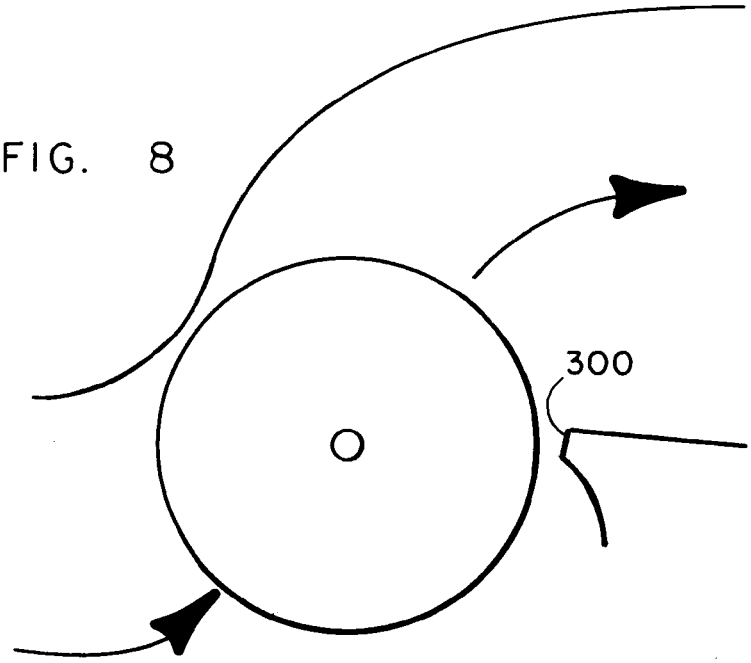

CUTOFF FOR FAN OR BLOWER

CROSS REFERENCE TO RELATED APPLICATION

This application is a Continuation-in-Part of co-pending U.S. Patent Ser. No. 10/461,042, filed Jun. 13, 2003.

BACKGROUND OF THE INVENTION

The present invention is directed to improved blower housings of the type used to surround fans. More specifically, the present invention contemplates a blower housing with a cutoff having a radial dimension relative to the fan axis where the radial dimension varies from a greater distance at a cutoff midsection to a lesser distance at the cutoff ends. Moreover, the thickness of the cutoff face varies from narrower ends to a wider midsection, the cutoff angle varies from end to midsection, and the slope of the cutoff face may vary.

Previous blowers, such as that shown in U.S. Pat. No. 5,279,515 to Moore et al., include a scroll housing which expands from a cutoff in a continuous and smoothly increasing radial dimension from that cutoff to a discharge outlet. The scroll housing is enclosed by a pair of side walls to enclose a blower and to form a discharge plenum. The discharge plenum is outside of the blower's periphery and inside of the scroll housing and sidewalls. The plenum is characterized by a continuously increasing cross-sectional area basically formed by the radial expansion of the scroll housing away from the periphery. This discharge plenum is defined by a rectangular footprint in a plane perpendicular to the axis of the blower and having edges tangent to the scroll housing at locations spaced approximately 90° from each other. The cutoff is linear and parallel to the axis of the rotation of the fan.

U.S. Pat. No. 5,570,996 to Smiley, III shows a scroll housing having a conformal portion of constant radius preceding the expansion portion of the scroll housing.

U.S. Pat. No. 5,868,551 to Smiley III et al. shows a cutoff for a tangential fan. The fan cutoff 120 has an edge 122 proximal the tangential fan where the edge is not parallel to the fan axis but instead is skewed relative to the axis 14 so that the edge spirals around the periphery of the tangential fan preferably while maintaining a constant gap G between the fan 12 and the edge 122. Effectively, the cutoff angle changes but the gap does not.

U.S. Pat. No. 5,772,399 to Mehta et al. shows a centrifugal fan 10 using a cutoff faring 32. Being of slideable construction, the cutoff faring 32 may be extended a greater or lesser distance into the exit port 15. This is illustrated by a comparison of FIGS. 5 and 6 where the cutoff faring is extended the fullest possible distance H1 in FIG. 5 as opposed to the lowest distance H2 in FIG. 6. The cutoff is linear and parallel to the axis of rotation of the fan.

U.S. Pat. No. 6,677,564 to Shon et al. shows a microwave oven having a blower apparatus with a cutoff portion. The shape of the cutoff portion forms a 'V' shape or a 'U' shape, and a first inclined surface 471 and a second inclined surface 472 can be formed as a straight or curved line.

Cutoffs are a tradeoff between efficiency preventing recirculation of air from the discharge path, stability of fan operation, and quietness of the fan. Previous cutoffs such as described above are usually a compromise between efficiency, stability, and sound levels but not all three. It would be desirous to provide a cutoff for a fan or blower which is both highly stable and efficient in its operation and having an optimum sound level.

SUMMARY OF THE INVENTION

It is an object, feature and advantage of the present invention to improve previous blowers.

It is a further object, feature and advantage of the present invention to provide a blower housing which has an improved cutoff.

It is an object, feature and advantage of the present invention to provide a blower housing having a cutoff having end portions closer to an axis of blower rotation than a cutoff mid-section. It is a further object, feature and advantage of the present invention that the cutoff have a smooth continuous edge. It is a still further feature and advantage of the present invention that the edge arc symmetrically from its ends to that midsection.

It is an object, feature and advantage of the present invention to provide a cutoff for a fan where the cutoff has an edge which is not parallel to the fan's axis of rotation. It is a further object, feature and advantage of the present invention that the cutoff edge be non-linear. It is a still further object, feature and advantage of the present invention that an angle between a cutoff end differ from a related angle through the cutoff midsection. It is another object, feature and advantage of the present invention that the cutoff have a face with a thickness that varies. It is preferable that the face thickness be greater at the midsection than at the ends.

It is an object, feature and advantage of the present invention to provide a blower housing having a cutoff which balances performance stability and improved efficiency with improved sound levels. It is a further object, feature and advantage of the present invention to reduce material, cost and drag in comparison to previous housings.

The present invention provides a cutoff for a blower housing. The cutoff has an edge including a first end having a first radial dimension relative to the axis, a second end having a second radial dimension relative to an axis, and a midsection having a third radial dimension relative to the axis. The third radial dimension is greater than either of the first or second radial dimensions. Preferably the edge transitions from the midsection to the first end by a continuously varying dimension always greater than the first dimension.

The present invention additionally provides a blower arrangement. The arrangement comprises a fan having an outer periphery of blades arranged about an axis; and a housing arranged about the fan. The housing has an inlet and an outlet and forms a first airflow path from the housing inlet to the fan and forming a second airflow path from the fan to the housing outlet. The arrangement also comprises a cutoff longitudinally aligned between the cutoff and the outer periphery and separating the first and second airflow path. The cutoff includes a first longitudinal end radially spaced from the axis a first distance, a second longitudinal end radially spaced from the axis by a second distance, and a cutoff midsection located between the first and second longitudinal ends and radially spaced from the axis by a third continuously varying distance where the third continuously varying distance has a magnitude greater than the first distance.

The present invention yet further provides a cutoff arrangement. The arrangement includes a blower having an axis and a plurality of blades equidistantly spaced about the axis in a radial direction. The arrangement also includes a blower housing having first and second housing inlets and a housing outlet arranged about the blower and forming an airflow path from the first and second housing inlets through the first and second blower inlets, through the blades and to the housing outlet. The blower has first and second blower inlets and a blower outlet. The housing further includes a cutoff arranged near and parallel to the blades to prevent cross circulation from the blower outlet to the blower inlet. The cutoff has an edge radially spaced from the blades in a direction away from the axis. The cutoff edge is generally aligned relative to the axis. The cutoff edge has a first end, a cutoff middle section and a cutoff end where the first and second cutoff ends are radially closer to the axis than the cutoff middle section.

The present invention still further provides a method comprising the steps of: providing a fan cutoff with an edge having a first end, a midsection, and a second end; aligning the cutoff edge parallel to an axis of a fan; spacing the cutoff edge radially from the axis and from the fan; and continuously curving the cutoff edge such that the midsection is radially farther from the axis than the first or second cutoff ends.

The present invention moreover provides a blower comprising apparatus providing a fan cutoff with an edge having a first end, a midsection, and a second end; apparatus aligning the cutoff edge parallel to an axis of a fan; apparatus spacing the cutoff edge radially from the axis and from the fan; and apparatus continuously curving the cutoff edge such that the midsection is radially farther from the axis than the first or second cutoff ends.

The present invention also provides a cutoff for an air moving device such as a fan or blower. The cutoff includes an axis for the air moving device; a first end; a second end; a mid-area; a point in the mid-area; an arbitrary reference line; a first angle formed between the reference line and a line from the first end and a point on the reference line; and a second angle formed between the reference line and a line from the mid-area point and the point on the reference line. The second angle is less than the first angle.

The present invention additionally provides a cutoff for an air moving device. The cutoff includes a first end; a second end; and a cutoff edge extending from the first end to the second end. The cutoff edge has a thickness forming a face on the edge between the first and second ends. The cutoff also includes a point located on the edge approximately equidistant from the first end and from the second end wherein the thickness of the face decreases as a distance from the point on the edge increases.

The present invention further provides a cutoff for an air moving device such as a fan or blower. The cutoff includes an edge with a first end, a second end, and a midsection with a midpoint. The edge has a non-linear shape which is arced from the midpoint to the first end and arced from the midpoint to the second edge. This nonlinear shape is symmetrical about the midpoint.

The present invention still further provides a cutoff for an air moving device such as a blower or a fan. The cutoff includes a first end; a second end; a mid-area; and an edge extending from the first end through the mid-are to the second end. The edge has a first thickness at the first end, a second thickness at the mid-area, and a third thickness at the second end. The second thickness does not equal the first thickness.

The present invention yet further provides an air moving device such as a fan or blower. The device includes an axis; a housing arranged about the axis and forming an air pathway; and a cutoff in the housing forming a starting line for the path. The cutoff includes a first end area, a second end area, a midsection area and an edge extending from the first end area to the mid-section area to the second end area. A distance from the midsection area to the axis is greater than a distance from the first end area to the axis. The cutoff includes a face having a width where the face width is greater at the midsection area than at the first end area. The device includes an arbitrary reference line intersecting the axis at a first point and perpendicular to the axis; a first cutoff angle defined by a first line from a second point on the midsection area to the first point and the arbitrary reference line, and a second cutoff angle defined by a second line from a third point in the first end area to the first point and the arbitrary reference line. The first cutoff angle is greater than the second cutoff angle.

The present invention more further provides an air moving device such as a fan or blower. The device includes an axis; a housing arranged about the axis and forming an air pathway; and a cutoff in the housing forming a starting line for the path. The cutoff includes a first end area, a second end area, a midsection area, an edge extending from the first end area to the mid-section area to the second end area and a face having a width. The face width is greater at the midsection area than at the first end area. The device also includes an arbitrary reference line intersecting the axis at a first point and perpendicular to the axis; a first cutoff angle defined by a second line from a second point on the midsection area to the first point and the arbitrary reference line; and a second cutoff angle defined by a second line from a third point in the first end area to the first point and the arbitrary reference line. The first cutoff angle is greater than the second cutoff angle.

The present invention moreover provides an air moving device such as a fan or blower. The device includes an axis; a housing arranged about the axis and forming an air pathway; and a cutoff in the housing forming a starting line for the path. The cutoff includes a first end area, a second end area, a midsection area and an edge extending from the first end area to the mid-section area to the second end area. A distance from the midsection area to the axis is greater than a distance from the first end area to the axis. The device also includes an arbitrary reference line intersecting the axis at a first point and perpendicular to the axis; a first cutoff angle defined by a first line from a second point on the midsection area to the first point and the arbitrary reference line; and a second cutoff angle defined by a second line from a third point in the first end area to the first point and the arbitrary reference line. The first cutoff is greater than the second cutoff angle.

The present invention also provides an air moving device such as a fan or blower. The device includes an axis; a housing arranged about the axis and forming an air pathway; and a cutoff in the housing forming a starting line for the path. The cutoff includes a first end area, a second end area, a midsection area and an edge extending from the first end area to the mid-section area to the second end area. A distance from the midsection area to an air moving device axis is greater than a distance from the first end area to the axis. The cutoff also includes a face having a width where the face width is greater at the midsection area than at the first end area.

The present invention additionally provides an air moving device such as a fan or blower. The device includes an axis; a housing arranged about the axis and forming an air pathway; and a cutoff in the housing forming a starting line for the path. The cutoff includes a first end area, a second end area, a midsection area and an edge extending from the first end area to the mid-section area to the second end area. A first distance from the midsection area to the axis is greater than a second distance from the first end area to the axis.

The present invention yet also provides an air moving device such as a fan or blower. The device includes an axis; a housing arranged about the axis and forming an air pathway; and a cutoff in the housing forming a starting line for the path. The cutoff includes a first end area, a second end area, a midsection area, an edge extending from the first end area to the mid-section area to the second end area and a face having a width. The face width is greater at the midsection area than at the first end area.

The present invention yet additionally provides an air moving device such as a fan or blower. The device includes an axis; a housing arranged about the axis and forming an air pathway; and a cutoff in the housing forming a starting line for the path. The cutoff includes a first end area, a second end area, a midsection area and an edge extending from the first end area to the mid-section area to the second end area. The device also includes an arbitrary reference line intersecting the axis at a second point and perpendicular to the axis; a first cutoff angle defined by a first line from a second point on the midsection area to the first point and the arbitrary reference line, and a second cutoff angle defined by a second line from a third point in the first end area to the first point and the arbitrary reference line. The first cutoff angle is greater than the second cutoff angle.

BRIEF DESCRIPTION OF THE DRAWINGS

FIG. 2 is a view of the discharge, blower and cutoff of FIG. 1 taken along lines 2—2.

FIG. 3 is an end view of the cutoff of FIG. 1 taken along lines 3—3.

FIG. 5 is a table showing the relationship between various dimensions of the embodiments of FIG. 4.

FIG. 7 shows an alternative embodiment of the angular relationship shown in FIG. 6.

FIG. 8 is a perspective view of an embodiment of the present invention as applied to a cross-flow blower.

DETAILED DESCRIPTION OF THE DRAWINGS

Figure 1:
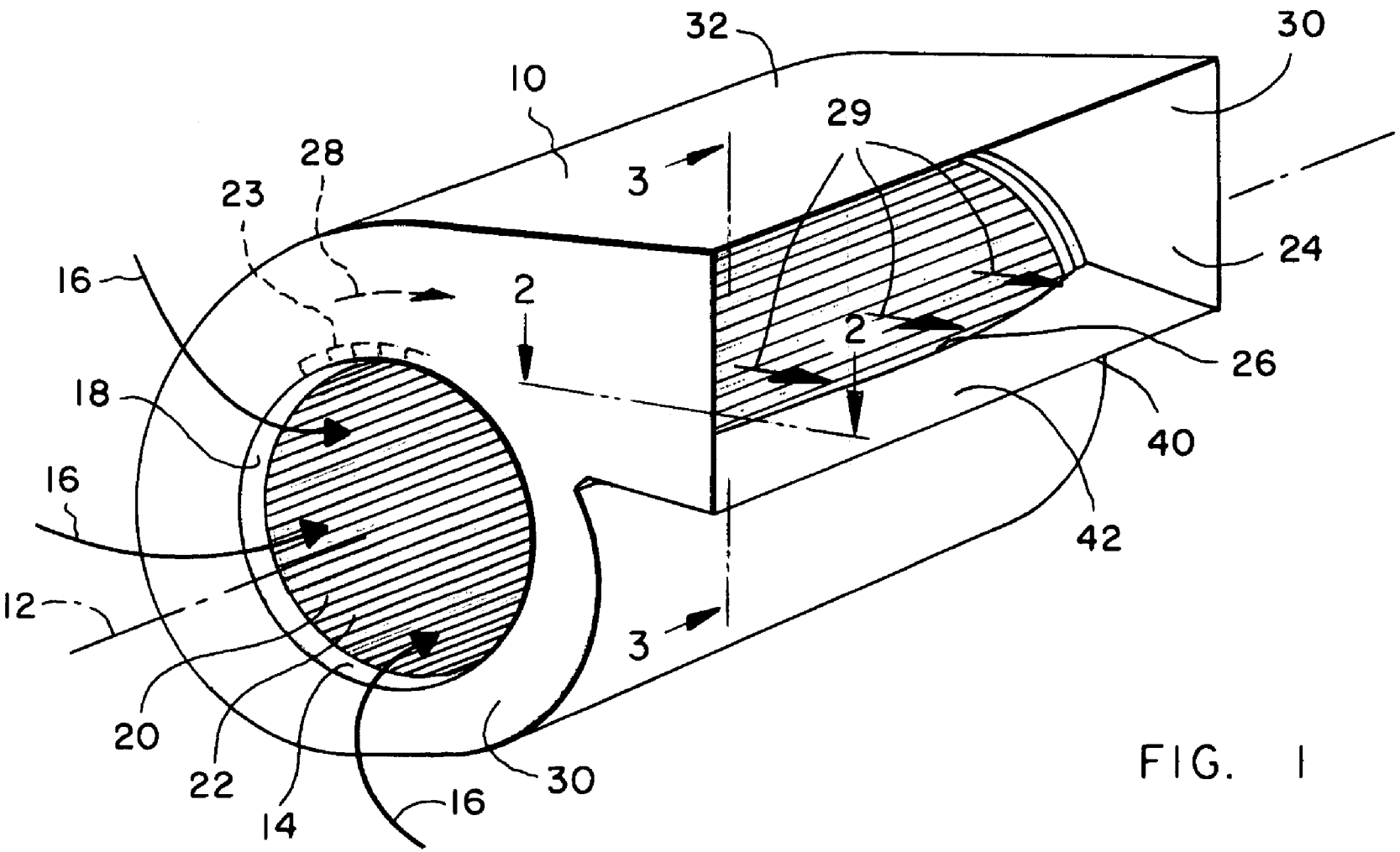
FIG. 1 is a perspective diagram of a first preferred embodiment of the improved blower and cutoff of the present invention.

The present invention is directed to an improved cutoff for a blower housing. In the context of this application, the term 'blower' include blowers, fans, centrifugal blowers, cross-flow blowers, impellers and other fluid moving devices and includes a blade set arranged in a cylindrical shape and rotating about a longitudinal axis. Exemplary blowers are shown in U.S. Pat. No. 5,279,515 to Moore et al., U.S. Pat. No. 5,570,996 to Smiley III, U.S. Pat. No. 5,772,399 to Mehta et al. and U.S. Pat. No. 5,868,551 to Smiley III et al. Each of these patents is commonly assigned with the present invention and each of these patents is hereby incorporated by reference.

In this application, like reference numerals are used to indicate like or similar elements.

FIG. 1 shows a blower housing 10 in accordance with the present invention. The blower housing 10 is oriented about an axis 12 and is typically formed of sheet metal, molded plastic, or the like. An inlet 14 is oriented about the axis 12 and allows a fluid such as air to enter the blower housing 10 thru the inlet 14 in an axial direction as indicated by axial direction arrow 16. A rounded entrance or bellmouth 18 to the inlet 14 is provided to smooth airflow. A blower 20 is oriented around the axis 12 and is radially spaced therefrom. The blower 20 receives the air from the inlet 14, turns the air into a radial direction and propels the air through the blades 22 of the blower 20 into a discharge airflow path 24. The blades 22 are arranged in a blade set 23 forming a rotating cylinder about the axis 12. The discharge airflow path 24 commences at a cutoff 26 and travels around the blower 20 as indicated by arrows 28. The airflow is discharged in a direction 29. The housing 10 includes a pair of end plates 30 and a scroll housing section 32 enclosing a portion of the discharge airflow path 24.

The blower 20 is rotated about the axis 12 by a motor (not shown) and draws air through the inlet 14 in an axial direction (a radial direction if a cross-flow or similar blower is implemented) and then turns the air into a radial direction perpendicular to the axis 12 so that the air is moved through the blower 20 into a discharge plenum 42. The discharge airflow path 24 commences at the cutoff 26 and travels around the blower 20 to the discharge outlet 40, passing through the scroll housing section 32 and the discharge plenum 42.

FIG. 2 shows an end on view of the blower 20 and cutoff 26 taken along lines 2—2 of FIG. 1. The cutoff 26 can be seen to have a face 48 and a non-linear edge 50 which are separated from a periphery 52 of the blower 20 by a varying distance 53. The cutoff edge 50 is the demarcation separating discharge airflow from recirculation. The cutoff face 48 is formed as an area between a discharge side edge 49 of the cutoff edge 48 and a entrance side edge 51 of the cutoff edge 48. Also referencing FIG. 3, a particular cutoff angle θ is defined as an angle between a line from a particular point on the cutoff edge 48 to the axis 12 and an arbitrary reference plane where the reference plane does not include the line.

The edge 48 has a first end 54, a midsection 56 and a second end 58. The area around the midsection 56 forms an acoustical reduction portion 61 promoting quieter airflow, whereas the areas around the first and second ends 54, 58 form efficiency enhancing portions 63 inhibiting recirculation and promoting stability. A radial distance from the periphery 52 of the blower is a first distance 60 at the first and second ends 54, 58 and a second distance 62 at the midsection 56. In the preferred embodiment, the second distance 62 is greater than the first distance 60. Thus, the midsection 56 is farther from the periphery 52 than the first and second ends 54, 58, and distance between the cutoff edge 50 and the periphery 52 varies continuously therebetween.

The distances 60 and 62 vary depending upon the cutoff design 26 and blower dimensions, but in the preferred embodiment the first distance 60 ranges from a minimum of 0.5% of the blower diameter to a maximum of 5% of the blower diameter while the second distance 62 varies continuously over a range from a minimum of 2.5% of the blower diameter to a maximum of 15% of the blower diameter. Although these ranges overlap, the first and second distances 60, 62 are selected so that the second distance 62 is greater than the first distance 60. In the preferred embodiment, the first distance 60 is approximately 2% of the blower diameter and the maximum second distance is approximately 6% of the blower diameter.

The edge 50 can be described as being symmetrical and continuous about a midpoint 64 with the result that the edge 50 forms an elliptical shape. In the acoustical reduction portion 61, this elliptical shape has a first flattened arc relative to the axis 12. In the efficiency enhancement portion 63, the elliptical shape has a second sharper arc relative to the axis 12.

FIG. 3 shows the blower, and cutoff of FIG. 1 in an end view taken along lines 3—3 of FIG. 1.

The scroll portion 32 expands in a radial direction relative to the axis 12 such that a radial dimension 34 in the discharge airflow path 24 near the cutoff 26 is less than a radial dimension 35 in the discharge airflow path 24 nearer the outlet 40 of the housing 10. The cutoff edge 50 is also not parallel to the axis 12 such that a cutoff angle $\theta_1$ between an arbitrary plane P intersecting the axis 12 and a line intersecting the axis and a point on a cutoff end 54, 58 is different than a cutoff angle $\theta_2$ between the arbitrary plane P and a line through the axis 12 and a point on the midsection 56.

The cutoff edge 50 has a cutoff angle $\theta$ from any particular point on the edge 50 when a reference line RL through a point on that edge and the axis 12 is compared to the arbitrary reference plane P. In the case of FIG. 3, the reference plane P is selected as lying perpendicular to the discharge outlet 40 and containing the axis 12.

In the preferred embodiment of the present invention, the edge 50 does not have a common cutoff angle $\theta$ through its length from the first end 54 to the second end 58. Rather, the cutoff angle $\theta_1$ at an end point 54, 58 is greater than the cutoff angle $\theta_2$ at the midpoint 64. Since the cutoff edge 50 preferably, but not necessarily, has a smooth continuous curve, the cutoff angle $\theta$ will vary over the length of the cutoff edge 50. In the preferred embodiment, the cutoff angles $\theta_1$ at the end points 54, 58 differ from the cutoff angle $\theta_2$ at the midpoint 64 by 11 degrees. The difference between the cutoff angle $\theta_1$ at the end points 54, 58 may differ from the cutoff angle at the midpoint 64 over a range of 1 to 30 degrees. Preferably, the cutoff angle $\theta_1$ at the end point 56 is the same as that of the end point 54, but these cutoff angles $\theta_1$ may vary such that the cutoff angle $\theta_1$ at the end point 54 does not equal the cutoff angle $\theta_1$ at the end point 54 where particular acoustical or efficiency enhancements are desired. In such case, the cutoff angle $\theta_1$ at the end point 54 may be greater than the cutoff angle $\theta_2$ at the midpoint 64, which in turn may be greater than the cutoff angle $\theta_1$ at the end point 58. Otherwise, the cutoff angle $\theta_2$ at the midpoint 64 may be greater than the cutoff angle $\theta_1$ at the end point 58, which in turn may be greater than the cutoff angle $\theta_1$ at the end point 56. This is further illustrated with regard to FIGS. 6 and 7.

FIG. 4 shows a number of embodiments where the distance to the cutoff edge 50 from the blower periphery 52 varies, and where the width of the face 48 also may vary. Table of FIG. 5 and the drawings of FIG. 4 illustrate these embodiments.

Figure 4A:
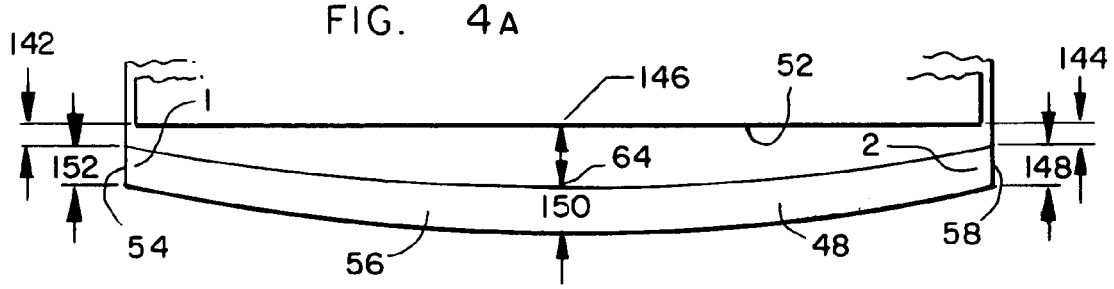
FIG. 4 are views of the face of the cutoff and the cutoff edge in relation to the blower as taken along lines 4—4 of FIG. 1 as shown in relation to embodiments 4A–4E.

FIG. 4A illustrates an embodiment where the face and the edge have symmetrical dimensions relative to the midpoint 64. For example, a distance at the first end point 54 is indicated by end point 1 as a distance 142 from the cutoff edge 50 and the blower periphery 42. The distance at the other end point 58, end point 2, is represented by 144 and is equal to the distance 142. The distance at the midsection is represented by 146 and is greater than either distance 142 or distance 144. In this embodiment FIG. 4A, the face 48 has a constant width thus a distance at end point 1 has a dimension 152 which is substantially the same as a dimension at the midpoint 64 represented by the distance 150 which in turn is substantially the same as the distance at the end point 2 as represented by a distance 148.

Figure 4B:
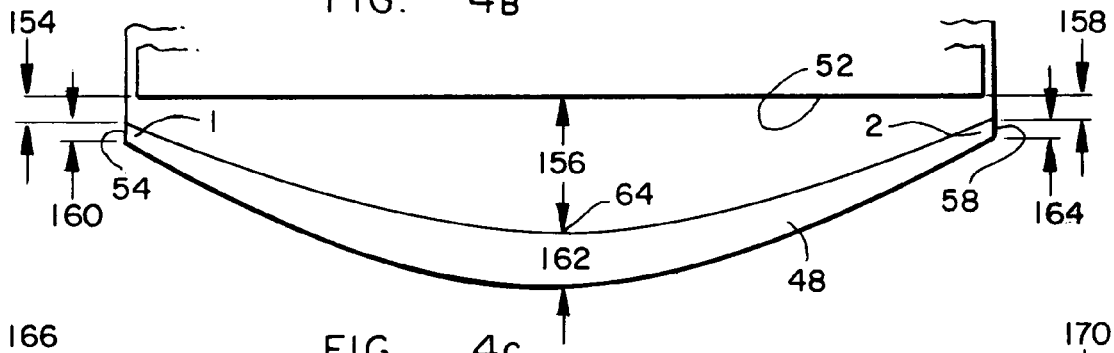

The embodiment of FIG. 4B illustrates the preferred embodiment where both the distance from the blower and the width of the face 48 can be greater at the midpoint 64. Essentially the distance at end point 1 is represented by 154 and the distance at end point 2 is represented by a dimension 158, the dimensions 154 and the 158 being equal. The distance from the blower periphery 52 is represented by a dimension 156 at the midpoint 64 and the dimension 156 is greater than the dimensions 154 and 158. Similarly, the width of the face at the end point 1 is represented by a dimension 160 and the width of the face at the end point 2 is represented by a dimension 164. The dimensions 164 and 160 are approximately the same, while the width of the face of the midpoint 164 is represented by a dimension 162 which is greater than either of dimensions 164 or 160.

Figure 4C:
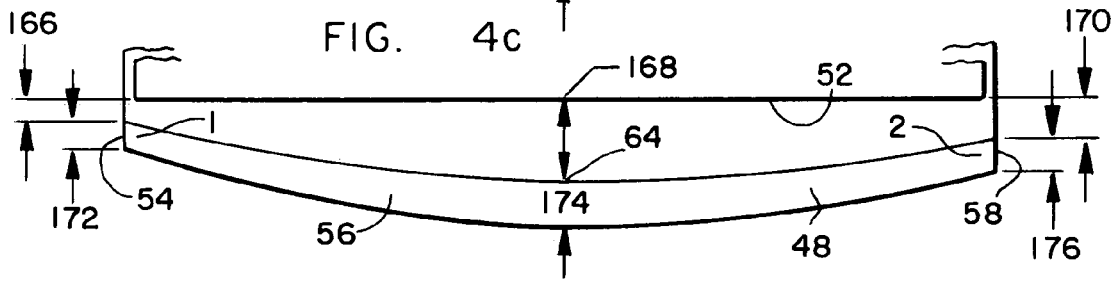

FIG. 4C illustrates an embodiment where the width of the face is substantially constant but the distances from the blower periphery are not symmetrical about the point 64. Essentially end point 1 is represented by a distance 166, the midpoint is represented by a distance 168 and the end point 2 is represented by a distance 170 where the distance 168 is greater than the distance 170 which in turn is greater than the distance 166. At the same time, the dimension of the face has equal dimensions 172 and 176 of the respective end point 1 and end point 2 while the dimension of the face at the midpoint 64 has a dimension 174 which is greater than either of dimensions 172 or 176.

Figure 4D:
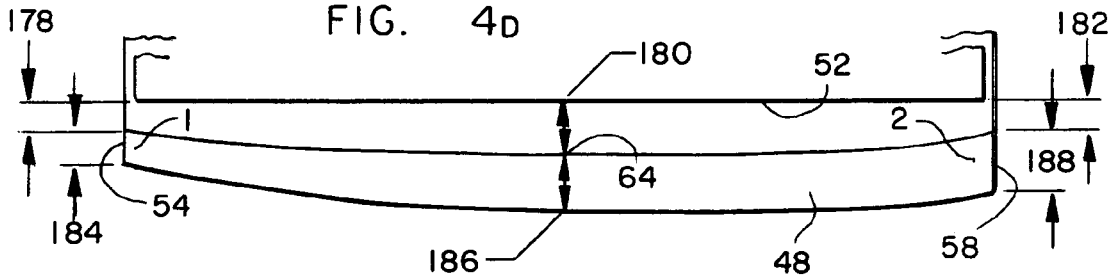

FIG. 4D represents an embodiment where the distance from the cutoff edge to the blower periphery 52 is symmetrical about the midpoint 64 but the width of the face is not. Specifically, the end point dimensions 178 for end point 1 and 182 for end point 2 are the same and are less than the dimension 180 at the midpoint. The width of the face 48 has a dimension 184 at end point 1 which is less than a corresponding dimension 188 at end point 2. The dimension at the end point 2 188 is less than the dimension 186 at the midpoint 64.

Figure 4E:
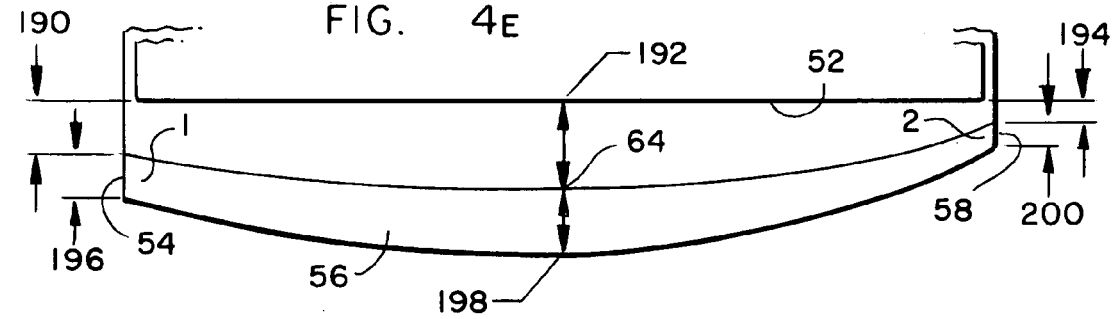

FIG. 4E illustrates the embodiment where both the width of the face and the distance from the periphery 52 are not symmetrical about the midpoint 64. In this embodiment, the end point 1 has a dimension 190 which is greater than the corresponding dimension 194 of the end point 2. The dimension 190, however, is less than the dimension 192 at the midpoint 64. At the same time, the width of the face is narrowest at a dimension 200 at end point 2 and is somewhat greater at the end point 1 where its dimension is 196. A midpoint dimension 198 of the face 48 is still greater than either of the dimensions 196 or 200.

Figure 6A:
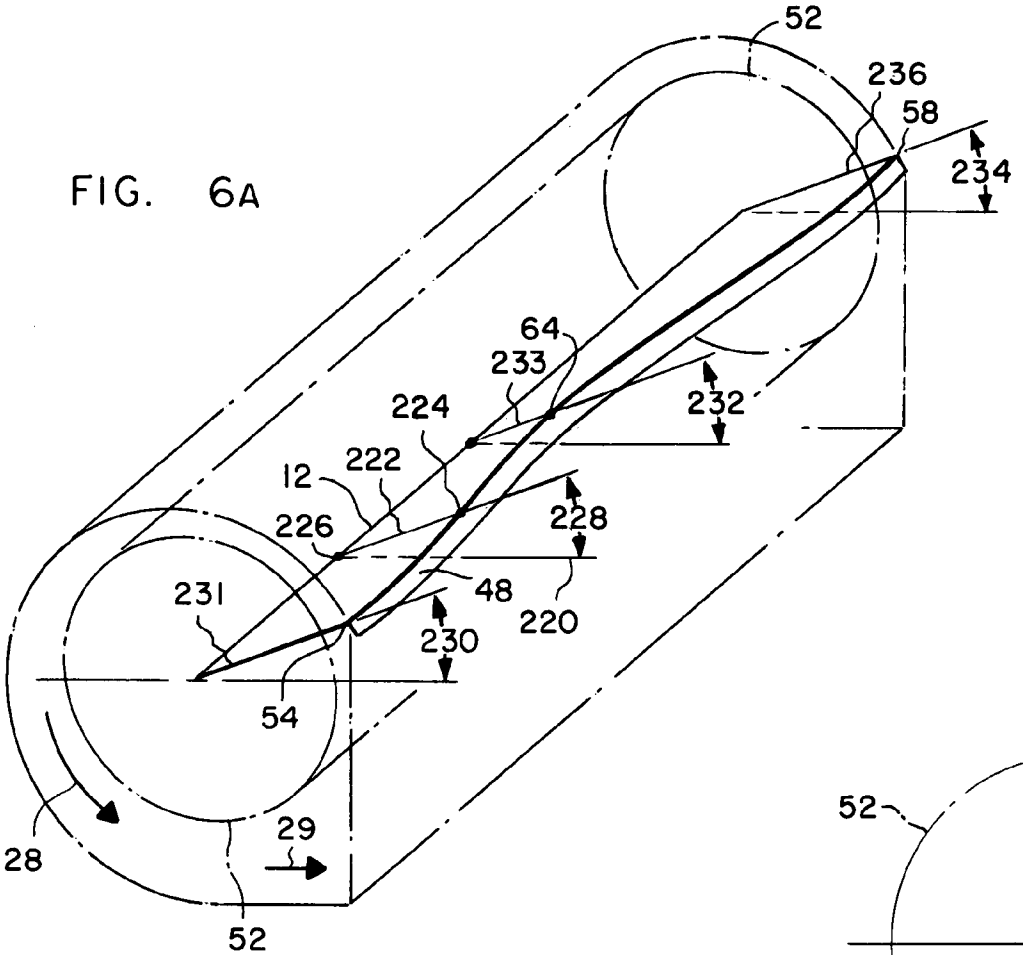
FIGS. 6A and 6B show the angular relationship between the end points and midpoints of the cutoff edge and face of FIG. 1 relative to an arbitrary reference plane through the blower axis.
Figure 6B:
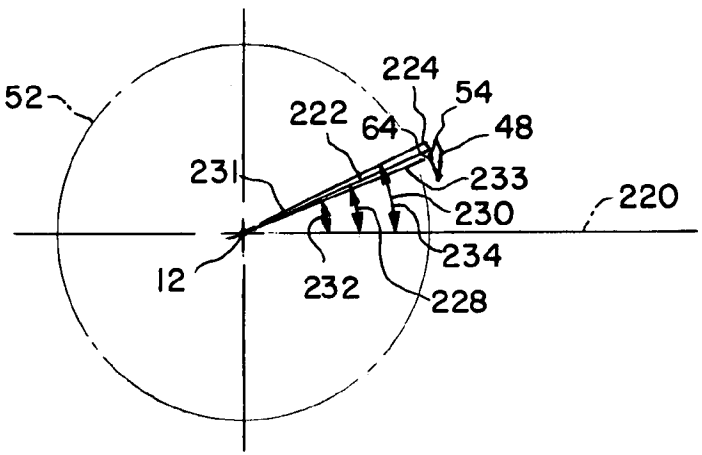

FIGS. 6A and B illustrate that the cutoff angle $\theta$ of the cutoff face 48 varies along the length of the cutoff. Given an arbitrary reference plane 220 normal to the axis and closer to the end 54 and a midpoint 64, a line 222 between an arbitrary point 224 on the edge 50 and a point 226 on the axis 12 will result in a cutoff angle 228 which varies over the length of the cutoff edge. Specifically the cutoff angle 230 will be less than a corresponding cutoff angle 232 taken at the midpoint 64. In the preferred embodiment, a cutoff angle 234 taken on the 236 relative to the end 58 and the axis 12 will be the same as the angle 230.

FIG. 7 is an alternative embodiment of the varying cutoff angle $\theta$ shown in FIGS. 6A and B where the cutoff angle 234 relative to the end 58 is different from and greater than the cutoff angle 230 relative to the end 54. In other words, the cutoff angle at one end differs from the cutoff angle at the opposite end.

The non-linear cutoff edge 50 is preferably but not necessarily symmetrical about the midpoint 64. The symmetricality of the edge 50 is such that a series of points equally spaced on either side of the midpoint 64 are equal in their magnitude of their distance while point of unequal spacing have different magnitudes. For example, a distance between point 66 on the periphery 52 and point 68 on the edge 50 has a magnitude 70. Due to the symmetry about the point 64 and the corresponding point 72 on the periphery 52, a distance between a point 74 spaced the same distance 76 will have the same magnitude 70 from a point corresponding on the edge 50. A similar dimension 80 respectively taken between points 82 and 84 on the periphery 52 and between points 86 and 88 on the edge 52 will have the same dimension 80 if spaced a corresponding distance 90 from the midpoint 64.

Essentially, it can be seen that the distance between the cutoff edge 50 and the periphery 52 is smaller at the ends 54 and 58 as exemplified by the distance 60 and increases progressively and continuously through distances 80 and 70 to a maximum 62 at the midpoint 64 of the midsection 56.

The cutoff edge 50, although described as an edge, has a face 48 with width. Preferably this width varies such that the width of the face 48 is narrower proximal the cutoff ends 54, 58 and wider proximal the midsection 56. The increased width results in a blunt face 48 generally facing and generally perpendicular to the direction of discharge airflow.

As perhaps best illustrated with regard to FIGS. 2 and 4(*b*), the face 48 has width with thickness which decreases as distance from the midsection 56 increases. The face 48 is preferably continuous but may be discontinuous including a sawtooth edge or a signwave edge as respectively shown in FIGS. 6 and 8 of U.S. Pat. No. 5,868,551 to Smiley III et al.

Figure 9A:
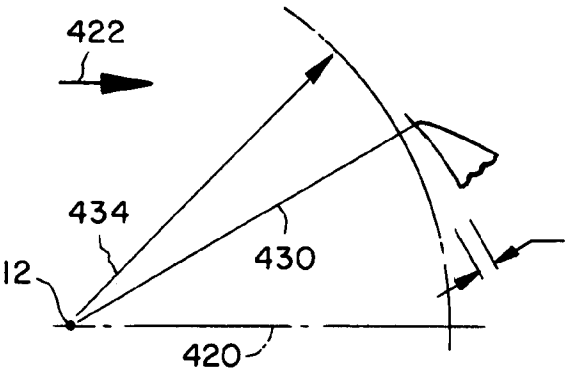
FIG. 9A–9E are sections of FIG. 2 taken along lines A—A, B—B, C—C, D—D and E—E.
Figure 9B:
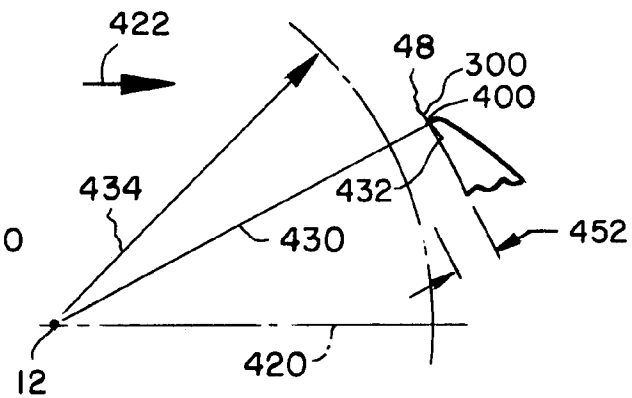
Figure 9C:
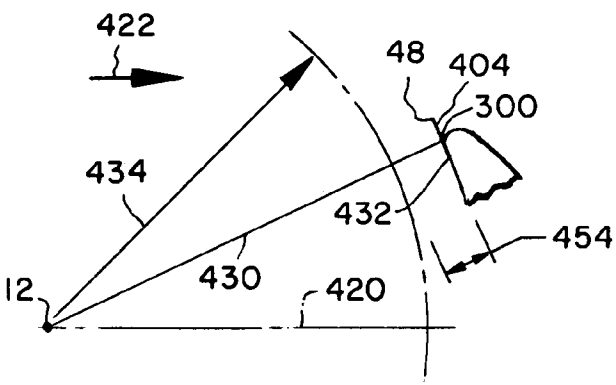
Figure 9D:
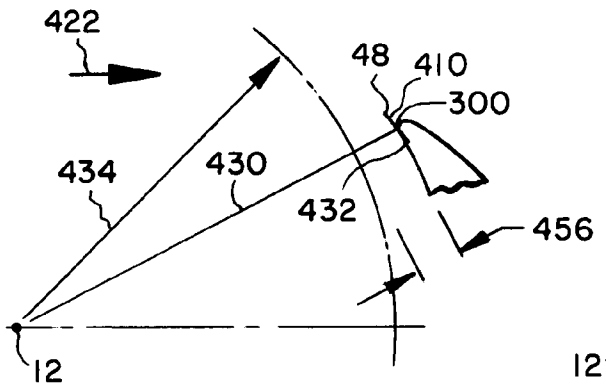
Figure 9E:
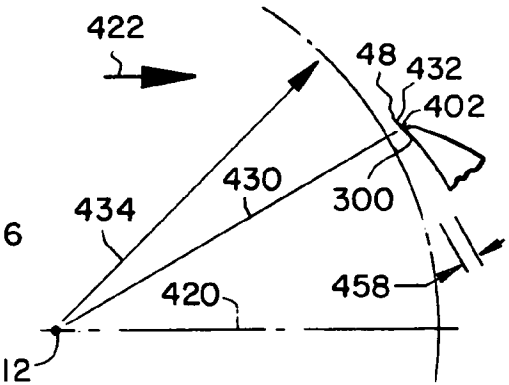

FIGS. 9A through 9E illustrate how the ratio of a first distance 430 from the axis 12 to an arbitrary point 432 on the face 48 to a second distance 434 from the axis 12 to the periphery 52 varies over the edge 48. The ratio is always greater at the midsection 56 than at either end 54, 58. In the preferred embodiment that ratio varies symmetrically as distance from the midsection 56 changes to the ends 54, 58. A distance between the first distance 430 and the second distance 434 varies in FIGS. 9A–9E such that in FIG. 9A the difference between distance 434 and 430 is indicated by the gap 450, the distance between the distance 430 and the distance 434 is indicated in FIG. 9B by the gap 452, and the distance between the distance 430 and the distance 434 is indicated in FIG. 9C by the gap 454. The distance between the distance 434 and the distance 430 is shown in FIG. 9D by the gap 456, while the distance between the first distance 430 and the second distance 434 in FIG. 9E is indicated by the gap 458. In a symmetrical system the gaps 450 and 458 will be approximately the same magnitude. Similarly the gaps 452 and 456 will be approximately the same magnitude in a symmetrical system. An asymmetrical embodiment where the ratio at the first end 54 differs from the ratio at the second end 58 is also contemplated. In this asymmetrical embodiment, the ratio will also vary asymmetrically about the midsection 56. In an asymmetrical system, the magnitude of the gaps 450 and 458 will differ. The similarity, the magnitude of the gaps 456 and 452 will differ depending on the nature of the asymmetrical system.

What has been described in this application is an improved blower housing cutoff for a centrifugal fan or the like which provides better efficiency and stability with reduced sound levels. It will be apparent to a person of ordinary skill in the art that many improvements and modifications are possible to this blower including varying the shape, arc and curvature of the cutoff. Such modifications include the use of various materials in forming the blower. Additionally, although the invention is described in terms of a cutoff edge which is symmetrical about a midpoint, non-linear asymmetrical cutoffs are also contemplated. All such modifications and improvements are contemplated to full within the spirit and scope of the claimed invention.

What is desired to be secured for letters patent of the United States is set forth in the following claims.

The invention claimed is:

1. A cutoff for a blower housing comprising:

a cutoff having an edge, the edge including a first end having a first radial dimension relative to an axis, a second end having a second radial dimension relative to the axis, and a midsection have a third radial dimension relative to the axis wherein the third radial dimension is greater than the first or second radial dimensions;

wherein the edge arcs symmetrically from the first and second ends to the midsection.

2. The cutoff of claim 1 further including a first efficiency enhancing portion located on the edge proximal the first end, a second efficiency enhancing portion located on the edge proximal the second end, and an acoustical reduction section located proximal the midsection.

3. The cutoff of claim 2 wherein the efficiency enhancing portion has at least a first arc and wherein the acoustical reduction section has at least a second arc and wherein the second arc is greater than the first arc.

4. The cutoff of claim 1 wherein the cutoff is proximal to a blower operably arranged to rotate about the axis and wherein the edge is not parallel to the axis.

5. The cutoff of claim 1 wherein the first radial dimension is greater than the second radial dimension.

6. The cutoff of claim 1 further including:

an arbitrary reference line intersecting and perpendicular to the axis;

a first cutoff angle defined by a first line from the midsection to the axis and the arbitrary reference line; and a second cutoff angle defined by a second line from the first end to the axis and the arbitrary reference line;

wherein the first cutoff angle does not equal the second cutoff angle.

7. The cutoff of claim 6 further including a third cutoff angle defined by a third line from the second end to the axis and the arbitrary reference line wherein second cutoff angle is approximately the same as the third cutoff angle.

8. The cutoff of claim 6 further including a third cutoff angle defined by a third line from the second end to the axis and the arbitrary reference line wherein second cutoff angle is different than the third cutoff angle.

9. A cutoff for a blower housing comprising:

a cutoff having an edge, the edge including a first end having a first radial dimension relative to an axis, a second end having a second radial dimension relative to the axis, and a midsection have a third radial dimension relative to the axis wherein the third radial dimension is greater than the first or second radial dimensions;

wherein the cutoff is proximal a blower having a diameter and wherein the first, second and third radial dimensions are respectively in the ranges of 0.5%–5% of the blower diameter, 0.5%–5% of the blower diameter and 2.5%–15% of the blower diameter.

10. The cutoff of claim 9 wherein the first radial dimension is approximately 2% of the blower diameter, wherein the second radial dimension is approximately 2% of the blower diameter and wherein the third radial dimension is approximately 6% of the blower diameter.

11. The cutoff of claim 9 wherein the cutoff is formed as an integral part of the blower housing.

12. A cutoff for a blower housing comprising:

a cutoff having an edge, the edge including a first end having a first radial dimension relative to an axis, a second end having a second radial dimension relative to the axis, and a midsection have a third radial dimension relative to the axis wherein the third radial dimension is greater than the first or second radial dimensions;

wherein the cutoff edge includes a face having a width which is greater at the midsection than at either the first or second ends.

13. The cutoff of claim 12 further including a point in the midsection which is equidistant from the first end and the second end and wherein the face has a slope which varies in relation to a point distance from the point.

14. A blower arrangement comprising:

a fan having an outer periphery of blades arranged about an axis;

a housing arranged about the fan, the housing having an inlet and an outlet and forming a first airflow path from the housing inlet to the fan and forming a second airflow path from the fan to the housing outlet;

a cutoff aligned between the blower and the outer periphery and separating the first and second airflow paths, the cutoff including a first cutoff end radially spaced from the axis a first distance, a second cutoff end radially spaced from the axis by a second distance, and a cutoff midsection located between the first and second cutoff ends and radially spaced from the axis by a third continuously varying distance where the third continuously varying distance has a magnitude greater than the first distance.

15. The blower arrangement of claim 14 wherein the first distance ranges between 0.5% of the blower diameter and 5% of the blower diameter, the second distance ranges between 0.5% of the blower diameter and 50 of the blower diameter, and the third distance ranges between 2.5% of the blower diameter and 15% of the blower diameter.

16. The blower arrangement of claim 15 wherein the third distance is preferably 6% of the blower diameter.

17. The blower arrangement of claim 16 wherein the first distance is preferably 2% of the blower diameter and the second distance is preferably 2% of the blower diameter.

18. The blower of claim 14:

the fan wheel is rotatable about the axis and the outer periphery is formed by a cylindrical blade set rotating about and parallel to the axis, the blade set including individual blades having first and second ends and a mid-portion ranging therebetween;

the first cutoff end being located proximal the first blade end and being spaced therefrom a third distance, the second cutoff end being located proximal the second blade end and being spaced therefrom by the third distance, and the middle cutoff section being located proximal the mid-portion of the blades and being spaced therefrom at least a fourth distance greater than the third distance.

19. The improved blower of claim 18 wherein the third distance varies continuously from the first cutoff end to the second cutoff end.

20. The improved blower of claim 19 wherein the cutoff midsection has an arc and first and second cutoff ends have a second arc which is less than the midsection arc.

21. The improved blower of claim 20 wherein the third distance ranges between 0.5% of the blower diameter and 5% of the blower diameter and wherein the fourth distance ranges between 2.5% of the blower diameter and 15% of the blower diameter.

22. The improved blower of claim 21 wherein the third distance is preferably 2% of the blower diameter and the fourth distance has a maximum dimension of 6% of the blower diameter.

23. A cutoff arrangement comprising:

a blower having an axis and a plurality of blades forming a periphery equidistantly spaced about the axis in a radial direction;

a blower housing having first and second housing inlets and a housing outlet arranged about the blower and forming an airflow path from the first and second housing inlets through the first and second blower inlets, through the blades and to the housing outlet;

the blower including first and second blower inlets and a blower outlet;

the blower housing further including a cutoff arranged near and parallel to the blades to restrict cross circulation from the blower outlet to the blower inlet wherein the cutoff has an edge radially spaced from the blades in a direction away from the axis and wherein the cutoff edge is generally aligned relative to the axis and wherein the cutoff edge has a first end, a cutoff middle section and a cutoff second end where the first and second cutoff ends are radially closer to the axis than the cutoff middle section;

wherein the blower has a diameter and wherein the first distance ranges between 0.5% and 5% of the blower diameter and wherein the second distance ranges between 2.5% and 15% of the blower diameter.

24. The cutoff arrangement of claim 23 wherein the first and second cutoff ends are spaced from the periphery by a first distance and wherein the cutoff middle section is spaced from the periphery by a second distance greater than the first distance.

25. The cutoff arrangement of claim 1 wherein the cutoff edge has a first arc of curvature proximal the first end and wherein the cutoff edge has a second arc of curvature proximal the cutoff middle section and wherein the cutoff edge has a third arc of curvature proximal the second cutoff end.

26. The cutoff arrangement of claim 25 wherein the arc of curvature of the first end is greater than the second arc of curvature.

27. The cutoff arrangement of claim 26 wherein the third arc of curvature is greater than the second arc of curvature.

28. The cutoff arrangement of claim 27 wherein the first and second arcs are substantially the same.

29. A blower comprising:

means for providing a fan cutoff with an edge having a first end, a midsection, and a second end;

means for aligning the fan cutoff edge relative to an axis of a fan;

means for spacing the fan cutoff edge radially from the axis and from the fan; and means for continuously curving the cutoff edge such that the midsection is radially farther from the axis than the first or second cutoff ends.

30. The blower of claim 29 further including means for providing the fan cutoff edge with a face having a width which is greater at the midsection than at either the first or the cutoff ends.

31. The blower of claim 30 wherein a width at the first cutoff end is the same as a width at the second cutoff end.

32. The blower of claim 30 wherein a width at the first cutoff end is different than a width at the second cutoff end.

33. The blower of claim 30 wherein the face has a slope relative to the axis and the slope varies from the first cutoff edge end to the second cutoff end.

34. The blower of claim 33 including means for varying the slope symmetrically about the midsection.

35. A cutoff for an air moving device comprising:

a first end;

a second end;

a cutoff edge extending from the first end to the second end, the cutoff edge having a thickness forming a face on the edge between the first and second ends; and a point located on the edge approximately equidistant from the first end and from the second end wherein the thickness of the face decreases as a distance from the point on the edge increases.

36. The cutoff of claim 35 wherein the face on the cutoff edge is continuous.

37. The cutoff of claim 35 wherein the face on the cutoff edge is discontinuous.

38. The cutoff of claim 37 wherein the discontinuous face has a sawtooth shape.

39. The cutoff of claim 35 wherein the face has a slope at any particular point on the face.

40. The cutoff of claim 39 wherein the slope is constant.

41. The cutoff of claim 39 where the slope varies.

42. The cutoff of claim 41 wherein the slope varies symmetrically about the point.

43. A cutoff for an air moving device such as a fan or blower comprising:

an edge with a first end, a second end, and a midsection having a midpoint, the edge having a non-linear shape arced from the midpoint to the first end and arced from the midpoint to the second edge, this nonlinear shape being symmetrical about the midpoint.

44. The cutoff of claim 43 wherein the air moving device includes an axis and wherein a line from the first end to the second end is substantially parallel to the axis and spaced a distance therefrom.

45. The cutoff of claim 44 wherein the midpoint is spaced a second distance from the axis where the second distance does not equal the first distance.

46. A cutoff for an air moving device such as a blower or a fan comprising:

a first end;

a second end;

a mid-area; and an edge extending from the first end through the mid-area to the second end, the edge having a first thickness at the first end, a second thickness at the mid-area, and a third thickness at the second end;

wherein the second thickness does not equal the first thickness.

47. The cutoff of claim 46 wherein the second thickness is greater than the first thickness.

48. The cutoff of claim 47 wherein the first thickness is approximately equal to the third thickness.

49. A method comprising the steps of:

providing a fan cutoff with an edge having a first end, a midsection, and a second end;

aligning the cutoff edge in relation to an axis of a fan;

spacing the cutoff edge radially from the axis and from the fan; and continuously curving the cutoff edge such that the mid-section is radially farther from the axis than the first or second cutoff ends.

50. The method of claim 49 further including the steps of providing the cutoff edge with a face having a width which is greater at the midsection than at either the first or the cutoff ends.

51. The method of claim 50 wherein a width at the first cutoff end is the same as a width at the second cutoff end.

52. The method of claim 50 wherein a width at the first cutoff end is different than a width at the second cutoff end.

53. The method of claim 50 wherein the face has a slope relative to the axis and the slope varies from the first cutoff edge end to the second cutoff end.

54. The method of claim 53 including the further step of varying the slope symmetrically about the midsection.

55. The cutoff edge of claim 49 including the further steps of angularly rotating the midsection relative to the axis in an arbitrary reference plane such that a midsection angle formed by a line through the midsection in the axis relative to the arbitrary plane differs from an angle formed at the first end from a point to the first end a line formed by a point to the first and the axis in the arbitrary reference plane.

56. The method of claim 55 including forming a third angle from a line through from the axis through a point on the second end in the arbitrary reference plane wherein the third angle is the same as the second angle.

57. The method of claim 55 including forming a third angle from a line through from the axis through a point on the second end in the arbitrary reference plane wherein the third angle differs from the second angle.

58. A cutoff for an air moving device such as a fan or blower comprising:

an axis for the air moving device;

a first end;

a second end;

a mid-area;

a point in the mid-area;

an arbitrary reference plane;

a first angle formed between the reference plane and a line from the first end and a point on the reference line;

a second angle formed between the reference plane and a line from the mid-area point and the point on the reference plane;

a third angle formed between the reference plane and a line from the second end and the point on the reference plane;

wherein the second angle does not equal the first angle and the first angle does not equal the third angle.

59. The cutoff of claim 58 wherein the air moving device provides discharge airflow in a first direction and the second angle is greater than the first angle if the reference plane is selected to be generally parallel to the first direction.

60. An air moving device such as a fan or blower comprising:

an axis;

a housing arranged about the axis and forming an air pathway;

a cutoff in the housing forming a starting line for the path;

the cutoff including a first end area, a second end area, a midsection area and an edge extending from the first end area to the mid-section area to the second end area wherein a distance from the midsection area to the axis is greater than a distance from the first end area to the axis;

the cutoff including a face having a width where the face width is greater at the midsection area than at the first end area;

an arbitrary reference plane including the axis and including at a first point on the axis;

a first cutoff angle defined by a first line from a second point on the midsection area to the first point and the arbitrary reference plane; and a second cutoff angle defined by a second line from a third point in the first end area to the first point and the arbitrary reference plane;

wherein the first cutoff angle does not equal the second cutoff angle.

61. An air moving device such as a fan or blower comprising:

an axis;

a housing arranged about the axis and forming an air pathway;

a cutoff in the housing forming a starting line for the path;

the cutoff including a first end area, a second end area, a midsection area and an edge extending from the first end area to the mid-section area to the second end area and including a face having a width where the face width is greater at the midsection area than at the first end area; and an arbitrary reference plane including the axis and a first point on the axis; and a first cutoff angle defined by a second line from a second point on the midsection area to the first point and the arbitrary reference plane, a second cutoff angle defined by a second line from a third point in the first end area to the first point and the arbitrary reference plane;

wherein the first cutoff angle does not equal the second cutoff angle.

62. An air moving device such as a fan or blower comprising:

an axis;

a housing arranged about the axis and forming an air pathway;

a continuously curved cutoff in the housing forming a starting line for the path;

the cutoff including a first end area, a second end area, a midsection area and an edge extending from the first end area to the mid-section area to the second end area wherein a distance from the midsection area to the axis is greater than a distance from the first end area to the axis;

an arbitrary reference plane including the axis and a first point on the axis; and a first cutoff angle defined by a first line from a second point on the midsection area to the first point and the arbitrary reference plane, a second cutoff angle defined by a second line from a third point in the first end area to the first point and the arbitrary reference plane;

wherein the first cutoff angle does not equal the second cutoff angle.

63. An air moving device such as a fan or blower comprising:

an axis;

a housing arranged about the axis and forming an air pathway;

a cutoff in the housing forming a starting line for the path;

the cutoff including a first end area, a second end area, a midsection area and an edge extending from the first end area to the mid-section area to the second end area wherein a distance from the midsection area to an air moving device axis is greater than a distance from the first end area to the axis; and the cutoff including a face having a width where the face width is greater at the midsection area than at the first end area.

64. An air moving device such as a fan or blower comprising:

an axis;

a housing arranged about the axis and forming an air pathway; and a continuously curved cutoff in the housing forming a starting line for the path; the cutoff including a first end area, a second end area, a midsection area and an edge extending from the first end area to the mid-section area to the second end area wherein a first distance from the midsection area to the axis is greater than a second distance from the first end area to the axis;

a third distance from the second end area to the axis wherein the third distance is greater than the second distance.

65. The air moving device of claim 64 further including a third distance from the second end area to the axis wherein the second and third distances are approximately the same.

66. The air moving device of claim 64 wherein the cutoff includes an edge including a patterned feature such as a sawtooth or signwave edge.

67. An air moving device such as a fan or blower comprising:

an axis;

a housing arranged about the axis and forming an air pathway; and a cutoff in the housing forming a starting line for the path;

the cutoff including a first end area, a second end area, a midsection area and an edge extending from the first end area to the mid-section area to the second end area and including a face having a width where the face width is greater at the midsection area than at the first end area.

68. The air moving device of claim 67 further including a point in the midsection area which is equidistant from the first end area and the second end area the face having a slope.

69. The air moving device of claim 68 wherein the slope of the face varies.

70. The air moving device of claim 69 wherein the slope of the face varies symmetrically about the point.

71. The air moving device of claim 67 wherein the face width at the second end area is approximately the same as the face width of the first end area.

72. The air moving device of claim 67 wherein a face width at the second end area is different than a face width at the first end area.

73. An air moving device such as a fan or blower comprising:

an axis;

a housing arranged about the axis and forming an air pathway;

a continuously curved cutoff in the housing forming a starting line for the path;

the cutoff including a first end area, a second end area, a midsection area and an edge extending from the first end area to the mid-section area to the second end area;

an arbitrary reference plane including the axis and a second point on the axis;

a first cutoff angle defined by a first line from a second point on the midsection area to the first point and the arbitrary reference plane, a second cutoff angle defined by a second line from a third point in the first end area to the first point and the arbitrary reference plane;

wherein the first cutoff angle does not equal the second cutoff angle.

74. The air moving device of claim 73 further including a third cutoff angle defined by a third line from a fourth point in the second end area to a point on the axis and the arbitrary reference plane wherein second cutoff angle is approximately the same as the third cutoff angle.

75. The air moving device of claim 73 further including a third cutoff angle defined by a third line from a fourth point in the second end area to a point on the axis and the arbitrary reference plane wherein second cutoff angle is different than the third cutoff angle.

* * * * *

UNITED STATES PATENT AND TRADEMARK OFFICE

CERTIFICATE OF CORRECTION

PATENT NO. : 7,144,219 B2
APPLICATION NO. : 10/835376
DATED : December 5, 2006
INVENTOR(S) : Stephen S. Hancock It is certified that error appears in the above-identified patent and that said Letters Patent is hereby corrected as shown below:

In The Claims:

Claim 25, Column 12, Line 40, “claim 1” should read --claim 23--.

Claim 30, Column 12, Line 67, after the word “the” insert the word --second--.

Signed and Sealed this

Twelfth Day of June, 2007

JON W. DUDAS
*Director of the United States Patent and Trademark Office*